US006302116B1

(12) United States Patent
Copeland

(10) Patent No.: US 6,302,116 B1
(45) Date of Patent: Oct. 16, 2001

(54) FINGERNAIL PROTECTION DEVICE

(76) Inventor: Hattie A. Copeland, 233 Taft St. Southwest, Atlanta, GA (US) 30315

( * ) Notice: Subject to any disclaimer, the term of this patent is extended or adjusted under 35 U.S.C. 154(b) by 0 days.

(21) Appl. No.: 09/572,882

(22) Filed: May 19, 2000

(51) Int. Cl.[7] ..... A45D 29/00
(52) U.S. Cl. ..... 132/73; 2/21
(58) Field of Search ..... 132/73, 73.5, 285; 2/21, 455, 16; D3/29; D28/56, 57; D29/113, 114

(56) References Cited

U.S. PATENT DOCUMENTS

| | | | | |
|---|---|---|---|---|
| D. 329,923 | | 9/1992 | Thaxton . | |
| D. 342,057 | | 12/1993 | McGinley . | |
| 667,338 | * | 2/1901 | Rogers | 2/21 |
| 883,761 | * | 4/1908 | Taylor | 2/21 |
| 1,000,226 | * | 8/1911 | Arwine | 2/21 |
| 1,306,442 | * | 6/1919 | Sansotta | 2/21 |
| 1,316,292 | * | 9/1919 | Fleming | 2/21 |
| 2,251,551 | * | 8/1941 | O'Reilly | 2/21 |
| 2,389,831 | * | 11/1945 | Welsh | 2/21 |
| 2,712,313 | * | 7/1955 | Levy | 2/21 |
| 4,089,066 | | 5/1978 | Dethman . | |
| 4,577,648 | | 3/1986 | Dinerstein et al. . | |
| 4,960,138 | | 10/1990 | Kling . | |
| 4,966,174 | | 10/1990 | Stanczak . | |

* cited by examiner

*Primary Examiner*—Gene Mancene
*Assistant Examiner*—Eduardo C. Robert

(57) ABSTRACT

A fingernail protection device for preventing smudging, chipping or nicking of newly manicured fingernails. The fingernail protection device includes a plurality of cap-like members each having an open end and being adapted to cover about a user's fingernail for the protection thereof; and also includes fastener assembly for removably and securely fastening each cap-like member about the user's fingernail.

12 Claims, 2 Drawing Sheets

FINGERNAIL PROTECTION DEVICE

BACKGROUND OF THE INVENTION

1. Field of the Invention

The present invention relates to a nail protector and more particularly pertains to a new fingernail protection device for preventing smudging, chipping or nicking of newly manicured fingernails.

2. Description of the Prior Art

The use of a nail protector is known in the prior art. More specifically, a nail protector heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,966,174; 4,960,138; U.S. Pat. Nos. Des. 329,923; Des. 342,057; U.S. Pat. Nos. 4,089,066; and 4,577,648.

While these devices fulfill their respective, particular objectives and requirements, the aforementioned patents do not disclose a new fingernail protection device. The inventive device includes a plurality of cap-like members each having an open end and being adapted to cover about a user's fingernail for the protection thereof; and also includes fastener assembly for removably and securely fastening each cap-like member about the user's fingernail.

In these respects, the fingernail protection device according to the present invention substantially departs from the conventional concepts and designs of the prior art, and in so doing provides an apparatus primarily developed for the purpose of preventing smudging, chipping or nicking of newly manicured fingernails.

SUMMARY OF THE INVENTION

In view of the foregoing disadvantages inherent in the known types of nail protector now present in the prior art, the present invention provides a new fingernail protection device construction wherein the same can be utilized for preventing smudging, chipping or nicking of newly manicured fingernails.

The general purpose of the present invention, which will be described subsequently in greater detail, is to provide a new fingernail protection device which has many of the advantages of the nail protector mentioned heretofore and many novel features that result in a new fingernail protection device which is not anticipated, rendered obvious, suggested, or even implied by any of the prior art nail protector, either alone or in any combination thereof.

To attain this, the present invention generally comprises a plurality of cap-like members each having an open end and being adapted to cover about a user's fingernail for the protection thereof; and also includes fastener assembly for removably and securely fastening each cap-like member about the user's fingernail.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including Such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fingernail protection device which has many of the advantages of the nail protector mentioned heretofore and many novel features that result in a new fingernail protection device which is not anticipated, rendered obvious suggested, or even implied by any of the prior art nail protector, either alone or in any combination thereof.

It is another object of the present invention to provide a new fingernail protection device which may be easily and efficiently manufactured and marketed.

It is a further object of the present invention to provide a new fingernail protection device which is of a durable and reliable construction.

An even further object of the present invention is to provide a new fingernail protection device which is susceptible of a low cost of manufacture with regard to both materials and labor, and which accordingly is then susceptible of low prices of sale to the consuming public, thereby making such fingernail protection device economically available to the buying public.

Still yet another object of the present invention is to provide a new fingernail protection device which provides in the apparatuses and methods of the prior art some of the advantages thereof, while simultaneously overcoming some of the disadvantages normally associated therewith.

Still another object of the present invention is to provide a new fingernail protection device for preventing smudging, chipping or nicking of newly manicured fingernails.

Yet another object of the present invention is to provide a new fingernail protection device which includes a plurality of cap-like members each having an open end and being adapted to cover about a user's fingernail for the protection thereof; and also includes fastener assembly for removably and securely fastening each cap-like member about the user's fingernail.

Still yet another object of the present invention is to provide a new fingernail protection device that is easy and convenient to securely place upon one's fingertips Even still another object of the present invention is to provide a new fingernail protection device that allows the user to carry one with other activities that would otherwise be impossible with the newly manicured fingernails.

These together with other objects of the invention, along with the various features of novelty which characterize the invention, are pointed Out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
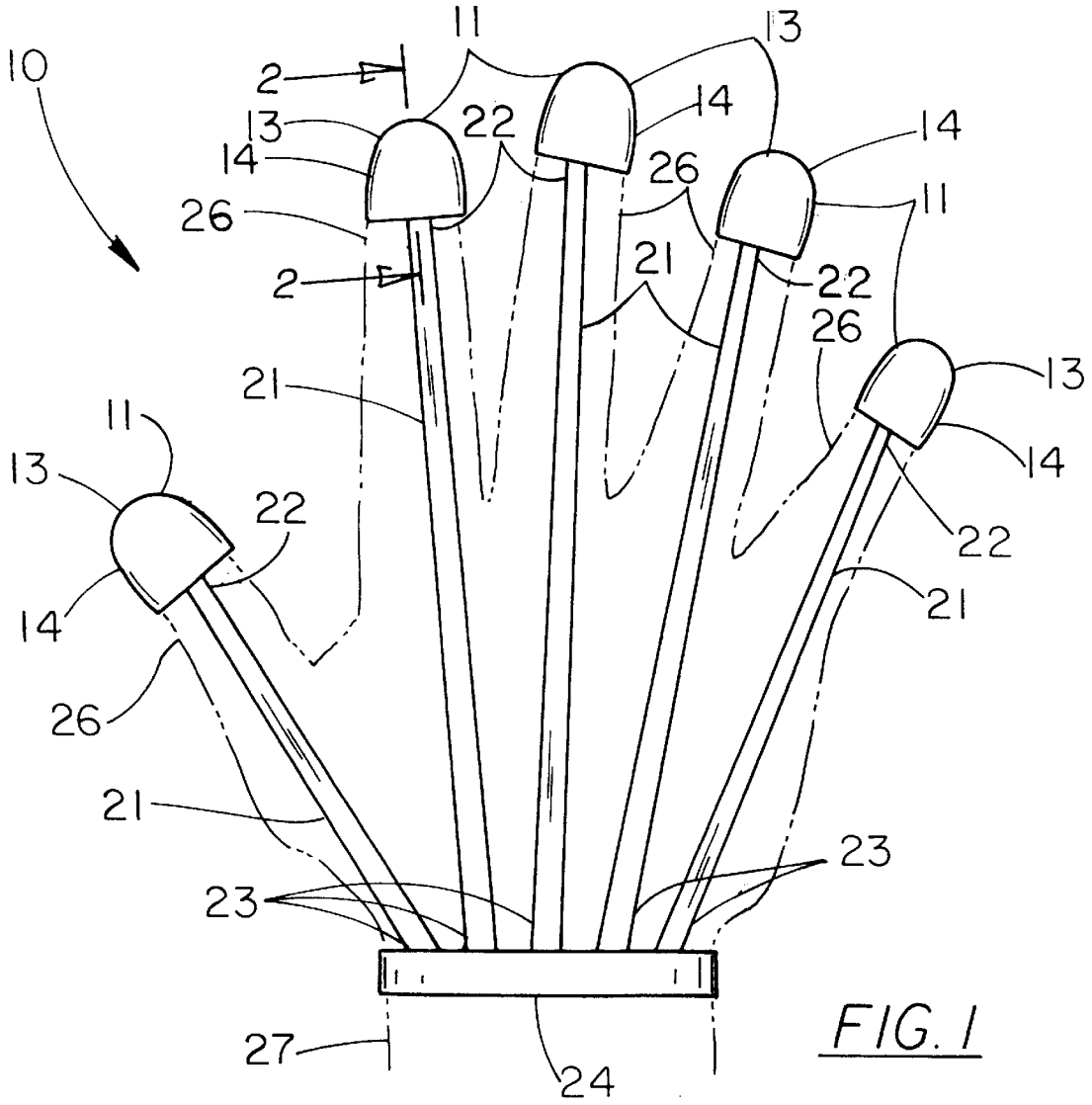
FIG. 1 is a side-elevational view of a first embodiment of a new fingernail protection device according to the present invention shown in use.
Figure 2:
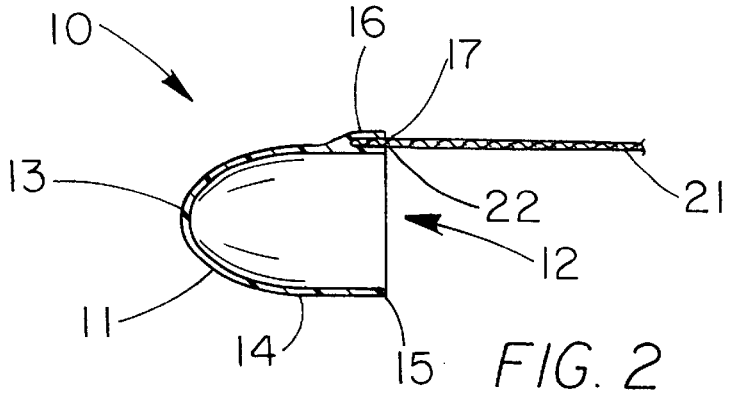
FIG. 2 is a cross-sectional view of the first embodiment of the present invention.
Figure 3:
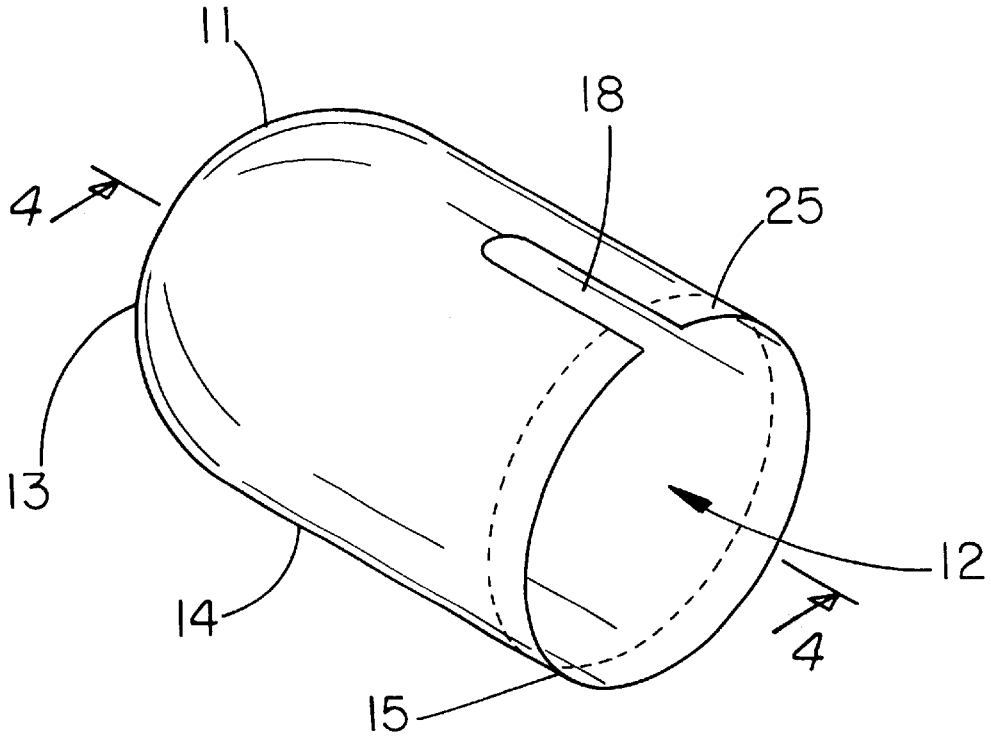
FIG. 3 is a perspective view of a second embodiment of the present invention.
Figure 4:
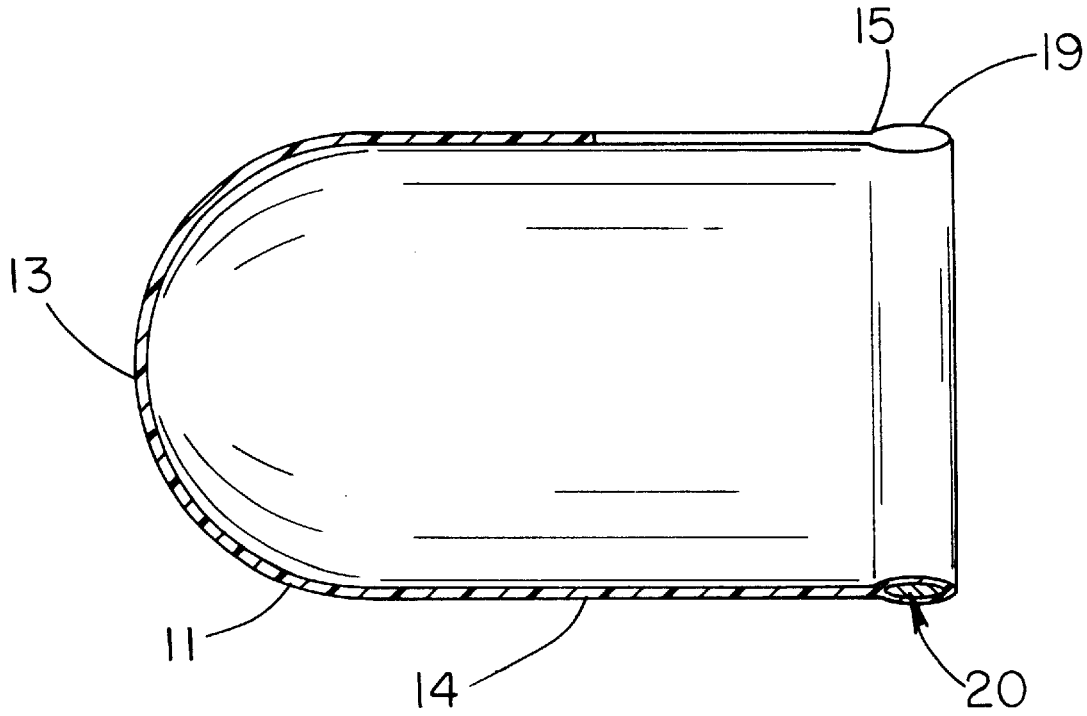
FIG. 4 is a cross-sectional view of the second embodiment of the present invention.

With reference now to the drawings, and in particular to FIGS. 1 through 4 thereof, a new fingernail protection device embodying the principles and concepts of the present invention and generally designated by the reference numeral 10 will be described.

As best illustrated in FIGS. 1 through 4, the fingernail protection device 10 generally comprises a plurality of cap-like members 11 each having an open end 12 and being adapted to cover about a user's fingernail for the protection thereof. Each cap-like member 11 includes a parabolic end 13, a side wall 14, and an end edge 15 of the side wall 14 at the open end 12 thereof with each cap-like member 11 being adapted to receive a respective fingertip 26 through the open end 12 thereof. The fingernail protection device 10 also includes fastener means for removably and securely fastening each cap-like member 11 about the user's fingernail.

As a first embodiment, each cap-like member 11 includes a strap-retaining member 16 securely and integrally attached to the side wall 15 at the end edge 15 thereof with the strap-retaining member 16 including a slot 17 extending therein. The fastening means includes a plurality of strap members 21 each having a first end 22 which is securely and conventionally engaged in the slot 17 of a respective strap-retaining member 16 and each further having a second end 23. The fastening means also includes a band member 24 having ends and being adapted to fasten about a user's wrist 27. The second ends 23 of the strap members 11 are securely and conventionally attached to the band member 24.

As a second embodiment, each cap-like member 11 includes a longitudinal slot 18 extending through the end edge 15 of the side wall 14 with the end edge 15 being essentially a loop 15 through which a bore 20 extends about a circumference of the cap-like member 11. The fastening means includes a plurality of bands 25 each being extended in the bore 20 of the loop 19 of a respective the cap-like member 11 for removably and securely fastening the cap-like member 11 about the user's fingertip 26 to retain the cap-like member 11 upon the user's finger.

In use, after the user has had one's fingernails manicured, the user can protect one's fingernails by placing the cap-like members 11 upon the fingertips 26 of the user covering one's fingernails and can secure the cap-like members 11 to the fingertips of the user using the fastening means.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the inventions to include variations in size, materials, shape, form, function and manner of operation, assembly and use, arc deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fingernail protection device comprising:

a plurality of cap-like members each having an open end and being adapted to cover about a user's fingernail for protecting the user's fingernail;

fastener means for removably and securely fastening each said cap-like member about the user's fingernail;

wherein each said cap-like member includes a parabolic end, a side wall and an end edge of said side wall at said open end thereof;

wherein each said cap-like member is adapted to receive a respective fingertip through said open end thereof;

wherein each said cap-like member includes a longitudinal slot extending through said end edge of said side wall, said end edge being essentially a loop through which a bore extends about a circumference of said cap-like member; and wherein said fastening means includes a plurality of bands each being extended in said bore of said loop of a respective said cap-like member for removably and securely fastening said cap-like member about the user's fingertip to retain said cap-like member upon the user's finger.

2. A fingernail protection device as described in claim 1, wherein each said cap-like member includes a strap-retaining member securely attached to said side wall at said end edge thereof.

3. A fingernail protection device as described in claim 1, wherein said strap-retaining member includes a slot extending therein.

4. A fingernail protection device as described in claim 3, wherein said fastening means includes a plurality of strap members each having a first end which is securely engaged in said slot of a respective said strap-retaining member and each further having a second end, said fastening means also including a band member having ends and being adapted to fasten about a user's wrist, said second ends of said strap members being securely attached to said band member.

5. A fingernail protection device comprising:

a plurality of cap-like members each having an open end and being adapted to cover about a user's fingernail for protecting the user's fingernail, each said cap-like member including a parabolic end, a side wall, and an end edge of said side wall at said open end thereof, each said cap-like member being adapted to receive a respective fingertip through said open end thereof;

fastener means for removably and securely fastening each said cap-like member about the user's fingernail;

wherein each said cap-like member includes a longitudinal slot extending through said end edge of said side wall, said end edge being essentially a loop through which a bore extends about a circumference of said cap-like member, said fastening means including a plurality of bands each being extended in said bore of said loop of a respective said cap-like member for removably and securely fastening said cap-like member about the user's fingertip to retain said cap-like member upon the user's finger.

6. A fingernail protection device as described in claim 5, wherein each said cap-like member includes a strap-retaining member securely attached to said side wall at said end edge thereof, said strap-retaining member including a slot extending therein, said fastening means including a plurality of strap members each having a first end which is securely engaged in said slot of a respective said strap-retaining member and each further having a second end, said fastening means also including a band member having ends and being adapted to fasten about a user's wrist, said second ends of said strap members being securely attached to said band member.

7. A fingernail protection device comprising:

plurality of cap-like members each having an upon end and being adapted to cover about a user's fingernail for protecting the user's fingernail;

fastener means for removably and securely fastening each said cap-like member about the user's fingernail;

wherein each said cap-like member includes a longitudinal slot extending through said end edge of said side wall, said end edge being essentially a loop through which a bore extends about a circumference of said cap-like member: and wherein said fastening means includes a plurality of bands each being extended in said bore of said loop of a respective said cap-like member for removably and securely fastening said cap-like member about the user's fingertip to retain said cap-like member upon the user'finger.

8. A fingernail protection device as described in claim 7, wherein each said cap-like member includes a parabolic end, a side wall, and an end edge of said side wall at said open end thereof.

9. A fingernail protection device as described in claim 8, wherein each said cap-like member includes a strap-retaining member securely attached to said side wall at said end edge thereof.

10. A fingernail protection device as described in claim 7, wherein each said cap-like member is adapted to receive a respective fingertip through said open and thereof.

11. A fingernail protection device as described in claim 7, wherein said strap-retaining member includes a slot extending therein.

12. A fingernail protection device as described in claim 11, wherein said fastening means includes a plurality of strap members each having a first end which is securely engaged in said slot of a respective said strap-retaining member and each further having a second end, said fastening means also including a band member having ends and being adapted to fasten about a user's wrist, said second ends of said strap members being securely attached to said band member.

* * * * *